United States Patent [19]

Smith

[11] 3,934,544

[45] Jan. 27, 1976

[54] ULTRASONIC WAVE TRANSMITTER MECHANISM

[75] Inventor: Theodore Dennis Smith, Indianapolis, Ind.

[73] Assignee: RCA Corporation, New York, N.Y.

[22] Filed: Mar. 18, 1974

[21] Appl. No.: 452,037

[52] U.S. Cl. ..... 116/137 A; 84/404

[51] Int. Cl.[2] ..... B06B 03/00

[58] Field of Search..... 116/137 A, 137 R, DIG. 19; 84/404

[56] References Cited

UNITED STATES PATENTS

| | | | |
|---|---|---|---|
| 2,920,604 | 1/1960 | McDonald, Jr. | 116/137 A |
| 3,017,849 | 1/1962 | Grossenherder | 116/137 A |
| 3,046,933 | 7/1962 | Kemeny | 116/137 A |
| 3,048,144 | 8/1962 | Vistain, Jr. | 116/137 A |
| 3,165,090 | 1/1965 | Smith | 116/137 A |
| 3,372,669 | 3/1968 | Sienkiewicz et al. | 84/404 X |
| 3,777,700 | 12/1973 | Lazzery | 84/404 X |

*Primary Examiner*—Jerry W. Myracle
*Assistant Examiner*—Daniel M. Yasich
*Attorney, Agent, or Firm*—E. M. Whitacre; P. M. Emanuel

[57] ABSTRACT

An ultrasonic wave transmitter employs a resonant rod to generate an ultrasonic wave in response to the striking of an end thereof by means of a striking member. A striking member support employed for controlling the movement of the striking member relative to the end of the rod is selectively positioned in contact with the end of the rod to provide for damping thereof following each striking.

9 Claims, 4 Drawing Figures

ULTRASONIC WAVE TRANSMITTER MECHANISM

BACKGROUND OF THE INVENTION

This invention relates to an ultrasonic wave transmitter for remote control systems and more particularly to a structure for the production and damping of ultrasonic waves.

Mechanical transmitters of the type which consist of a rod of a metallic material having a natural resonant frequency which transmits an ultrasonic wave by vibrating in a longitudinal mode when struck on one end thereof have been utilized for performing remote control functions in apparatus such as television receivers. To provide acceptable performance of this type of transmitter, it is essential that the rod be struck sharply enough so that the amplitude of the ultrasonic waves be large enough to actuate an associated remotely located receiver (for example, 20 to 30 feet away). Further, it is desirable that the duration of vibration of the rod be controllable by means of a damping element selectively coupled to the rod to effect an appropriate duration of signal as received by the remote control receiver. A variety of means has been used to strike and damp the rod to produce the desired result. One type of such apparatus may be found in U.S Pat. No. 3,777,700 -- Lazzery. The reduction of the complexity of components required to accomplish the aforementioned functions is desirable to reduce the cost of the transmitter without undesirably compromising its performance and reliability.

SUMMARY OF THE INVENTION

An ultrasonic wave transmitter comprises a resonant rod responsive to a striking of an end thereof by means of a striking member for producing an ultrasonic wave. A striking member support means is positionable in contact with the end of the rod for damping the rod and is positionable out of contact with the end of the rod for controlling the trajectory of the striking member. Resilient means is disposed relative to the support means and to the striking member for storing energy when the striking member is moved away from the end of the rod and relative to the support means. Actuating means is operatively associated with the support means for moving the support means out of contact with the end of the rod and for moving the striking member away from the end of the rod and relative to the support means. The support means movement relative to the actuating means movement is such that upon a predetermined movement of the actuating means the striking member is released from the actuating means, thereby releasing the energy of the resilient means for driving the striking member into momentary contact with the end of the rod. Upon release of the actuating means, the support means provides for damping of the rod by the support means being brought into contact with the end of the rod.

The invention will be further understood from the following description of a preferred embodiment thereof, when considered in connection with the accompanying drawings.

Detailed Description

Figure 1:
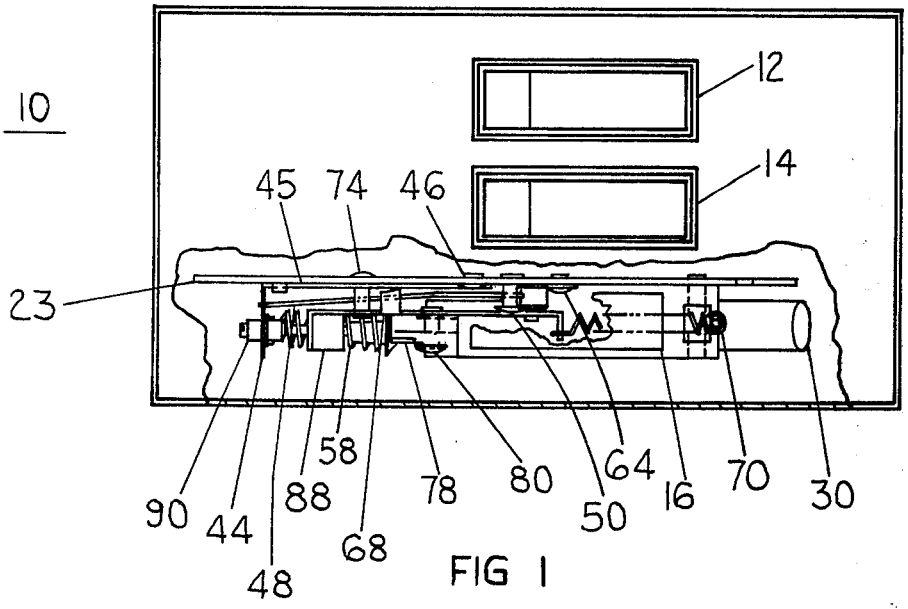
FIG. 1 is a top view of an ultrasonic transmitter embodying the invention wherein a section of the housing is cut away to expose a portion of the mechanism.
Figure 2:
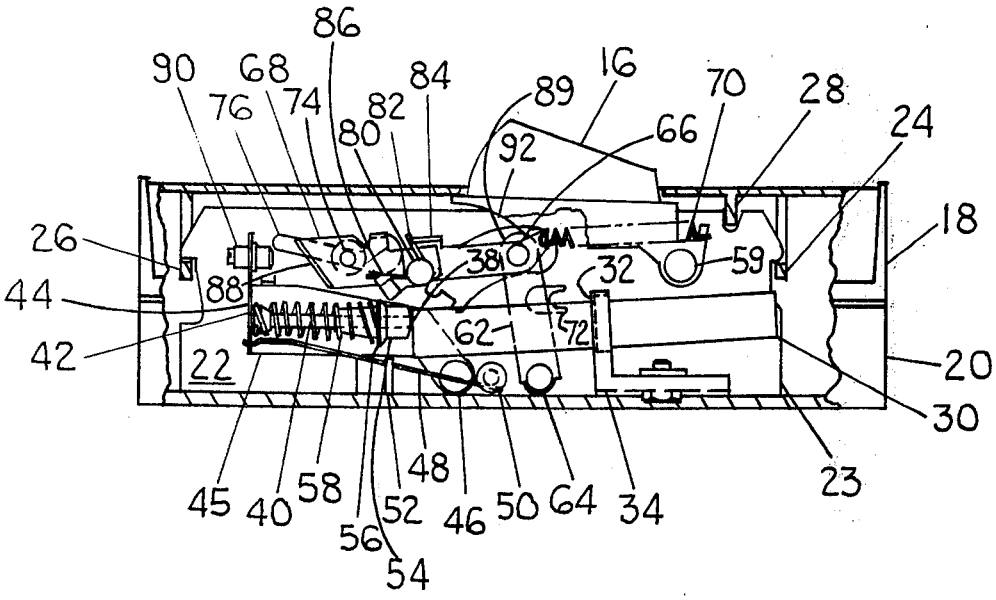
FIG. 2 is a side view of the mechanism of FIG. 1 shown in an unactuated state as viewed via the cut away section of the housing.
Figure 3:
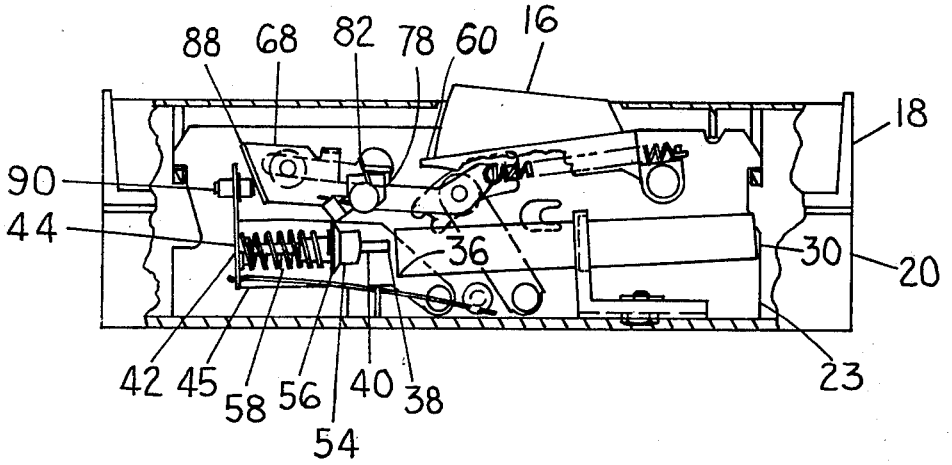
FIG. 3 is a side view of the mechanism of FIG. 1 shown in a partial state of actuation.
Figure 4:
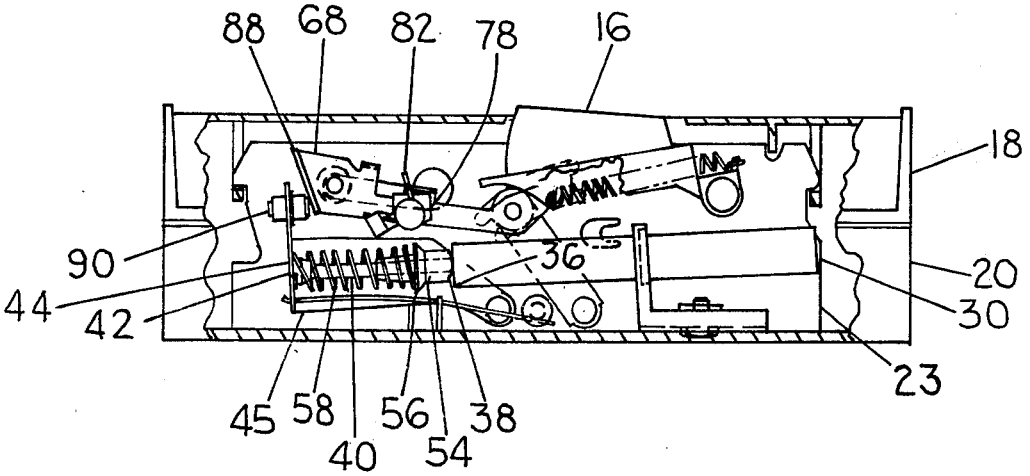
FIG. 4 is a side view of the mechanism of FIG. 1 shown in a state of full actuation.

Referring to the drawing wherein like elements are designated by like reference characters throughout the various FIGURES, the ultrasonic wave transmitter shown includes a housing 10 of a suitable material such as metal or plastic, and of a size adapted to be held in the hand by an operator. The transmitter is provided with suitable function actuator buttons 12, 14 and 16 which are movable vertically (as shown in FIGS. 2, 3 and 4). Each button, for example, operates an ultrasonic wave generating mechanism of the resonant rod type with longitudinal mode operation. Any suitable number of mechanisms may be provided, depending upon the number of remote functions to be controlled. A description of the mechanism for one such operating element will be provided.

As indicated in FIGS. 2–4, the housing 10 is constructed in two separable complementary parts comprising a top closure member 18 and a bottom portion 20. A base plate 23 for a mechanism 22 associated with button 16 is secured and laterally oriented in the top 18 by means of a front support 24 and a rear support 26. The mechanism 22 is oriented front to back in the top 18 by means of a locating rib 28 which extends downwardly from top 18 to engage base plate 23. A resonant rod 30 is supported at a node point 32 by means of a rod support 34. The rod support 34 is mounted on the base plate 23 in a manner placing an end 36 of the resonant rod 30 in contact with an end 38 of a striking member guide pin 40. The guide pin 40 is mounted at a point 42 on a striking member mounting flange 44. An extension 45 of flange 44 is pivotally mounted on the base plate 23 by, for example, a rivet 46. A cantilever spring 48, which maintains the end 38 of guide pin 40 in contact with the rod 30, is supported at one end, for example, by means of a rivet 50 attached to base plate 23 and approximately at its midpoint by means of a projecting element 52 of the base plate 23. The other end of the cantilever spring 48 is in contact with the mounting flange 44 and provides for a clockwise torque (as viewed looking into the paper) about the rivet 46, urging guide pin 40 against rod 30.

A striking member 54 is provided, for example, of a tubular form and having a radial flange 56 approximately midway between its ends. The striking member 54 is mounted concentric with the striking member guide pin 40 and is resiliently coupled to the mounting flange 44 at the point 42 by means of a striking member spring 58. In this manner, the striking member 54 may be moved relative to the end 38 of guide pin 40 and the mounting point 42 by compressing or extending the striking member spring 58. The end of the striking member 54 nearest the end 38 of the guide pin 40 is set back from the end 38 to insure that when the striking member spring 58 is in its free state, only the guide pin 40 will contact the rod 30.

The actuator button 16 is pivotally mounted on base plate 23 at a point 59. Clockwise rotation of the actuator button 16 relative to the point 59 is prevented by a flange 60 which contacts the top 18. A link 62 is pivotally mounted at one end on the base plate 23 by means of a rivet 64. The other end of the link 62 is coupled by means of a rivet or pin 66 to an actuator slide 68. The pivot point determined by the rivet 66 is urged toward the pivot point 59 by means of an actuator slide return spring 70 coupled between the actuator slide 68 and the actuator button 16. Movement of the pivot point determined by the rivet 66 relative to the pivot point 59 is limited by a tab 72 on the base plate 23. The end of the slide 68 opposite the end secured to the link 62 is slideably mounted to the base plate 23 by means of a rivet 74 which is firmly affixed to the slide 68 and is free to move in a slot 76 in the base plate 23. A pawl 78 is rotatably mounted on the slide 68 by means of a rivet 80. The pawl 78 is biased in a counterclockwise direction by means of a generally U-shaped wire pawl spring 82 having one end in contact with the pawl 78 and the other end in contact with the slide 68. The maximum counterclockwise rotation of the pawl 78 is determined by a stop flange 84 on the slide 68. The stop flange 84 therefore is one of the factors in determining the position of the end 86 of the pawl 78 relative to the striking member 54.

An inclined flange 88 on the end of the slide 68 remote from the link 62 provides for engagement with a protrusion on flange 44, which includes, where desired, a striking member release point adjustment screw 90. This engagement creates a counterclockwise rotation of the flange 44 relative to the rivet 46.

The actuator button 16 has an inclined surface 92 which engages a roller 89 axially mounted on the rivet 66 on the end of the link 62 to convert motion of the actuator button 16 downward relative to the top 18 to motion of the slide 68 to the left.

Since there are various stages of operation through which the mechanism 22 must go in order to provide for the production of ultrasonic waves in response to an actuation of the actuator button 16 and the damping of any remaining ultrasonic wave product upon the release of the actuator button 16, FIGS. 2–4 showing various stages of operation of the mechanism 22 will be described together.

In operation, the actuator button 16 is depressed relative to the top 18. The roller 89 follows the inclined surface 92 of the actuator button 16 thereby moving the actuator slide 68 away from pivot point 59. As the actuator slide 68 moves away from the pivot point 59, the end 86 of the pawl 78 engages the flange 56 of the striking member 54 and initiates a compression of the striking member spring 58. As the striking member spring 58 is further compressed, the inclined flange 88 contacts the adjustment screw 90 on the flange 44. Further depression of the actuator button 16 creates a counterclockwise rotation of the mounting flange 44 relative to the rivet 46, thereby withdrawing the end 38 of the guide pin 40 away from the end 36 of the resonant rod 30. This stage of depression of the actuator button 16 is illustrated in FIG. 3.

The end 86 of the pawl 78, throughout the various stages of operation of the mechanism 22, is maintained in a plane virtually parallel to the axis of the guide pin 40 prior to depression of actuator button 16.

Due to the counterclockwise rotation of the mounting flange 44 relative to the rivet 46 created by the force applied by the inclined flange 88 against the adjustment screw 90, the radial flange 56 of the striking member 54 is carried downward away from the end 86 of the pawl 78 at one point in the depression of the actuator button 16, as can be seen in FIG. 4. The energy stored in the striking member spring 58 is released, propelling the striking member 54 toward the end 36 of the rod 30. Kinetic energy imparted to the striking member 54 in the release of the energy from striking member spring 58 carries the striking member 54 beyond the point determined by the free length of the striking member spring 58. The maximum excursion of the striking member 54 carries it into contact with the end 36 of the resonant rod 30 which creates a longitudinal mode oscillation of the resonant rod 30. Preferably, the spring constant for striking member spring 58 is selected to insure a single contact with the rod 30 upon the release of energy stored in the striking member spring 58. The ultrasonic wave produced by the rod 30 then decays exponentially with time in the absence of outside influences. The amount of energy stored in the spring 58 prior to the release of the striking member 54 which determines the maximum amplitude of the ultrasonic wave produced by the mechanism 22 can be adjusted by means of adjustment screw 90.

To effect a controlled damping of the rod 30, the actuator button 16 is released as shown in FIG. 2, thereby allowing the inclined flange 88 of the actuator slide 68 to be withdrawn from the adjustment screw 90 by means of return spring 70. As the inclined flange 88 is withdrawn from the adjustment screw 90, the mounting flange 44 is caused to rotate clockwise relative to the rivet 46, by the urging of cantilever spring 48. A clockwise rotation of flange 44 causes end 38 of the guide pin 40 to come in contact with the end 36 of the rod 30. The contact of the guide pin 40 damps the oscillation of the rod 30, thereby quickly stopping the production of ultrasonic waves.

Thus, the duration of transmission of the ultrasonic waves is controlled by the operator in terms of how quickly the button 16 is released after it is depressed. The system described provides the desired results of operator controlled damping at one end of the wave generating rod.

It should be recognized that various modifications of the particular parts and arrangements hereinbefore described may be made within the scope of the present invention.

What is claimed is:

1. An ultrasonic wave transmitter comprising:

a rod responsive to striking thereof mounted for producing an ultrasonic wave;

a striking member;

a pivotally mounted means including a guide pin for slidably supporting said striking member for movement relative thereto, said pivotally mounted means rotatable to a first position with an end of said guide pin in contact with an end of said rod for providing damping controlled thereto and a second position with said end of said pin out of contact with said rod;

an actuating means movable from an initial position to a final position for moving said supporting means from said first position to said second position;

means coupled to said actuating means for engaging and moving said striking member away from said rod during initial motion of said actuating means and, upon a predetermined movement of said actuating means, for releasing said striking member;

a resilient means coupled to one end of said striking member and subject to a compression when said striking member is moved away from said rod, said resilient means imparting a force to drive said striking member when it is released into contact with said end of said rod and thereby generates said waves; and means coupled to said supporting means and responsive to return of said actuating means to said initial position for moving said pin to said first position in contact with said rod for damping said waves.

2. The combination as in claim 1 wherein said means for supporting said striking member comprises:

a mounting flange pivotally mounted at one end and having said guide pin secured thereto at the other end.

3. The combination as in claim 2 wherein said means for supporting said striking member further comprises a striking member release point adjustment means coupled to said mounting flange for adjusting said predetermined movement of said actuating means.

4. The combination as in claim 2 wherein said striking member is slideably mounted on said guide pin and said resilient means is coupled between said striking member and said mounting flange.

5. The combination as in claim 4 wherein said resilient means is a compression spring having a first end coupled to said mounting flange and a second end coupled to said striking member.

6. The combination as in claim 4 wherein said means coupled to said supporting means is a spring coupled to said mounting flange and mounted with respect to said rod for uging said guide pin against said rod.

7. The combination as in claim 4 wherein said striking member is of a tubular form being disposed about said guide pin and having a radial flange extending therefrom for engagement with said actuator means.

8. The combination as in claim 1 wherein said means coupled to said actuating means for engaging said striking member comprises:

a pawl pivotally mounted on said actuating means; and a bias spring for maintaining said pawl in engagement with said striking member during initial motion of said actuating means.

9. An ultrasonic wave transmitter comprising:

a base plate;

a rod responsive to striking thereof mounted for producing an ultrasonic wave and being supported on said base plate;

a striking member;

a pivotally mounted flange including a guide pin for slidably supporting said striking member for movement relative thereto, said flange rotatable to a first position with an end of said pin in contact with one end of said rod for damping said rod and in a second position with said pin out of contact with said end of said rod;

an actuator slide slideably mounted on said base plate;

a pawl pivotally mounted on said actuator slide and engageable with said striking member during an initial motion of said actuator slide and upon a predetermined movement of said actuator slide for releasing said striking member;

an actuator button pivotally mounted on said base plate and in engagement with said actuator slide to impart a sliding motion to said actuator slide for engaging said pawl with said striking member and said actuator slide with said supporting means to move said striking member and said supporting means away from said rod upon a pivotal movement of said actuator button from an initial position;

resilient means disposed relative to said supporting means and to said striking member for storing energy when said striking member is moved away from said end of said rod and for imparting energy to drive said striking member into contact with said end of said rod for generating said waves when said striking member is released; and means coupled to said supporting means and responsive to the return of said actuator button to said initial position to return said supporting means to said second position for damping said waves.

* * * * *